US011536188B2

(12) United States Patent
Masuda et al.

(10) Patent No.: US 11,536,188 B2
(45) Date of Patent: Dec. 27, 2022

(54) MARINE COOLING SYSTEM, MARINE PROPULSION DEVICE, AND MARINE VESSEL

(71) Applicant: YAMAHA HATSUDOKI KABUSHIKI KAISHA, Iwata (JP)

(72) Inventors: Chiharu Masuda, Shizuoka (JP); Norimitsu Nakatsugawa, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 17/574,602

(22) Filed: Jan. 13, 2022

(65) Prior Publication Data

US 2022/0260004 A1 Aug. 18, 2022

(30) Foreign Application Priority Data

Feb. 15, 2021 (JP) ..... JP2021-021600

(51) Int. Cl.

| | |
|---|---|
| ***F01P 7/14*** | (2006.01) |
| ***F01P 3/20*** | (2006.01) |
| ***B63H 20/30*** | (2006.01) |
| ***F01M 5/00*** | (2006.01) |
| ***B63H 20/28*** | (2006.01) |

(52) U.S. Cl.

CPC ..... *F01P 7/14* (2013.01); *B63H 20/28* (2013.01); *B63H 20/30* (2013.01); *F01M 5/002* (2013.01); *F01P 3/202* (2013.01); *F01P 3/205* (2013.01); *F01P 2007/146* (2013.01); *F01P 2050/02* (2013.01)

(58) Field of Classification Search

CPC ..... F01P 7/14; F01P 3/202; F01P 2007/146; F01P 3/205; F01P 3/207; F01P 2050/02; B63H 20/28; B63H 20/285; B63H 20/30; F01M 5/002

See application file for complete search history.

(56) References Cited

U.S. PATENT DOCUMENTS

2018/0163611 A1* 6/2018 Kishimoto ..... B63H 21/38

FOREIGN PATENT DOCUMENTS

JP 2018-096290 A 6/2018

* cited by examiner

*Primary Examiner* — Jacob M Amick

(74) *Attorney, Agent, or Firm* — Keating and Bennett, LLP

(57) ABSTRACT

A marine cooling system performs a temperature adjustment of an object to be cooled such as an internal combustion engine of a marine vessel. The marine cooling system includes a water supply flow passage to supply cooling water to the object, a water drain flow passage to drain the cooling water from the object to reduce an amount of the cooling water that contacts the object, and a flow passage controller to shut off the water to the drain flow passage.

14 Claims, 9 Drawing Sheets

MARINE COOLING SYSTEM, MARINE PROPULSION DEVICE, AND MARINE VESSEL

CROSS REFERENCE TO RELATED APPLICATIONS

This application claims the benefit of priority to Japanese Patent Application No. 2021-021600, filed on Feb. 15, 2021. The entire contents of this application are hereby incorporated herein by reference.

BACKGROUND OF THE INVENTION

1. Field of the Invention

The present invention relates to a marine cooling system, a marine propulsion device, and a marine vessel, each of which includes cooling flow passages.

2. Description of the Related Art

An outboard motor as a marine propulsion device is equipped with a cooling system for cooling an internal combustion engine. In such a cooling system, a cylinder head and a cylinder body of the internal combustion engine are cooled by flowing seawater, which functions as cooling water and is taken in from outside of the outboard motor, to a cooling flow passage.

In the case of storing a marine vessel, in order to avoid damage due to corrosion or freezing, it is necessary to remove the seawater from each part of the internal combustion engine. For example, the cylinder body is provided with a water drain hole that communicates with an internal water jacket. Further, when the marine vessel is stored, the seawater is discharged from the water jacket of the cylinder body through the water drain hole.

On the other hand, in order to prevent a large amount of cooling water from being discharged from the water drain hole when the internal combustion engine is in operation, the cooling water is supplied to the water drain hole by a water pump from an opposite side of the water jacket, and then the cooling water of the water jacket collides with the cooling water supplied by the water pump. This prevents a large amount of the cooling water from being discharged from the water jacket through the water drain hole when the internal combustion engine is in operation (see, for example, Japanese Laid-Open Patent Publication (kokai) No. 2018-96290).

In the case that the internal combustion engine is in a low load operation, or the like, the amount of the cooling water that is supplied to the water jacket of the cylinder body via another cooling flow passage may be reduced. In this case, the flow rate of the cooling water supplied by the water pump exceeds the flow rate of the cooling water flowing out from the water jacket through the water drain hole, and as a result, the cooling water supplied by the water pump may flow backward into the water drain hole and enter the water jacket, and may directly contact the cylinder disposed near the water drain hole to overcool the cylinder. Therefore, the cooling system provided in an outboard motor still has room for improvement from the viewpoint of temperature adjustment of the internal combustion engine.

SUMMARY OF THE INVENTION

Preferred embodiments of the present invention provide marine cooling systems, marine propulsion devices, and marine vessels that are each able to appropriately perform a temperature adjustment of an object to be cooled such as an internal combustion engine.

According to a preferred embodiment of the present invention, a marine cooling system to cool an object in a marine vessel includes a water supply flow passage to supply cooling water to the object, a water drain flow passage to drain the cooling water from the object to reduce an amount of the cooling water that contacts the object, and a flow passage controller to close the water drain flow passage.

According to another preferred embodiment of the present invention, a marine vessel includes a marine cooling system to cool an object, wherein the marine cooling system includes a water supply flow passage to supply cooling water to the object, a water drain flow passage to drain the cooling water from the object to reduce an amount of the cooling water that contacts the object, and a flow passage controller to close the water drain flow passage.

According to another preferred embodiment of the present invention, a marine propulsion device includes a marine cooling system to cool an object, wherein the marine cooling system includes a water supply flow passage to supply cooling water to the object, a water drain flow passage to drain the cooling water from the object to reduce an amount of the cooling water that contacts the object, and a flow passage controller to close the water drain flow passage.

According to another preferred embodiment of the present invention, a marine cooling system to cool an object in a marine vessel includes a water drain flow passage to drain cooling water from the object to reduce an amount of the cooling water from the object, and a flow passage controller to close the water drain flow passage.

According to the preferred embodiments of the present invention, since the water drain flow passage, which reduces an amount of the cooling water from the object, is closed by the flow passage controller, it is possible to prevent the cooling water from flowing backward in the water drain flow passage and flowing into the object to be cooled. As a result, it is possible to appropriately perform the temperature adjustment of the object to be cooled without overcooling the object.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1A:
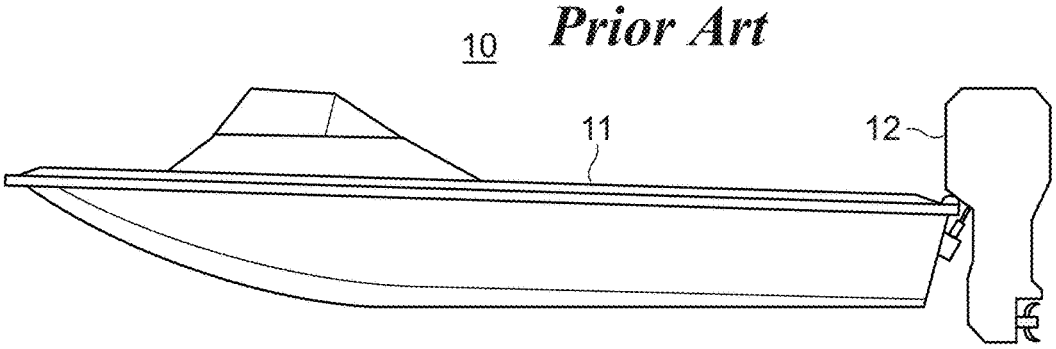
FIG. 1A Prior Art
FIGS. 1A and 1B are figures for explaining an outboard motor as a marine propulsion device to which a conventional marine cooling system is applied.
Figure 1B:
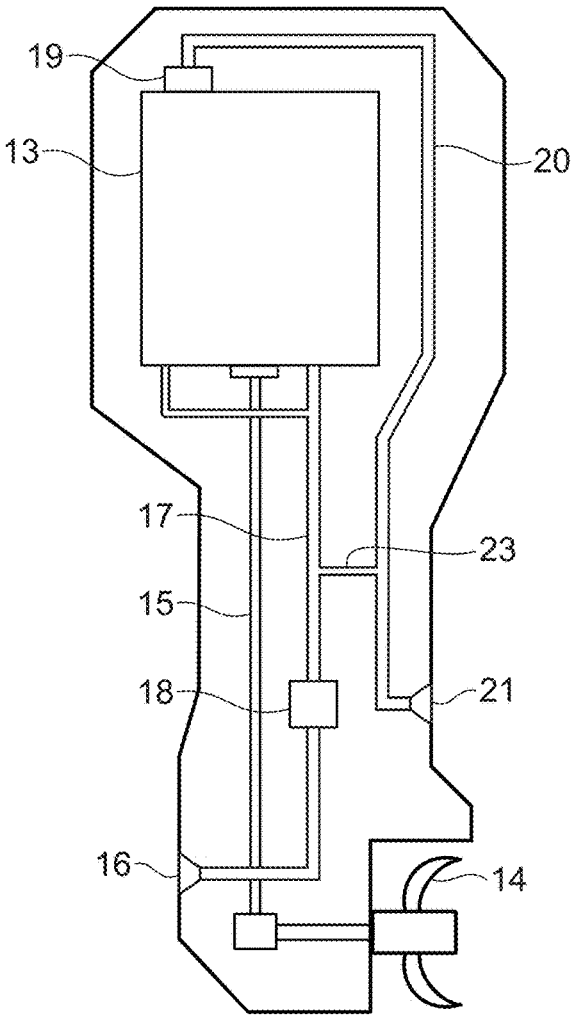
FIG. 1B Prior Art

FIGS. 1A and 1B are figures for explaining an outboard motor as a marine propulsion device to which a conventional marine cooling system is applied. Specifically, FIG. 1A is a side view of a marine vessel that is equipped with the outboard motor, and FIG. 1B is a schematic side view that schematically shows an internal configuration of the outboard motor.

A marine vessel 10 in FIG. 1A is, for example, a planing boat which includes a hull 11 and two outboard motors 12. The two outboard motors 12 are attached to the stern of the hull 11. The outboard motor 12 includes an engine (an internal combustion engine) 13 as a drive source, a propeller 14 as a propulsion unit, and a drive shaft 15 to transmit a driving force of the engine 13 to the propeller 14. The outboard motor 12 obtains a propulsive force by the propeller 14 which is rotated by the driving force of the engine 13. Moreover, the marine vessel, to which the outboard motor 12 is applied, is not limited to the planing boat, and may be, for example, a displacement type marine vessel.

The outboard motor 12 includes a water suction port 16 that takes in seawater, lake water, or river water as cooling water from the outside of the outboard motor 12, a water supply flow passage 17 to supply the cooling water taken in from the water suction port 16 to the engine 13, and a water pump 18 located in the water supply flow passage 17 to pressure-feed the cooling water toward the engine 13.

The water supply flow passage 17 is connected to a cylinder head 25 of the engine 13, and a drainage flow passage 20 is connected to a cylinder body 26 of the engine 13 via a thermostat 19. The drainage flow passage 20 is connected to a drainage port 21 that opens toward the outside of the outboard motor 12. A water drain flow passage 22 is connected to the cylinder body 26 of the engine 13 separately from the drainage flow passage 20, and the water drain flow passage 22 is connected to the water supply flow passage 17. Further, the water supply flow passage 17 and the drainage flow passage 20 are directly connected by a bypass flow passage 23.

In the outboard motor 12, the water suction port 16, the water supply flow passage 17, the water pump 18, the thermostat 19, the drainage flow passage 20, the drainage port 21, the water drain flow passage 22, and the bypass flow passage 23 define the conventional marine cooling system. Further, the water supply flow passage 17, the drainage flow passage 20, the water drain flow passage 22, and the bypass flow passage 23 include water channels, pipes, and/or hoses made of metal or resin.

Figure 2:
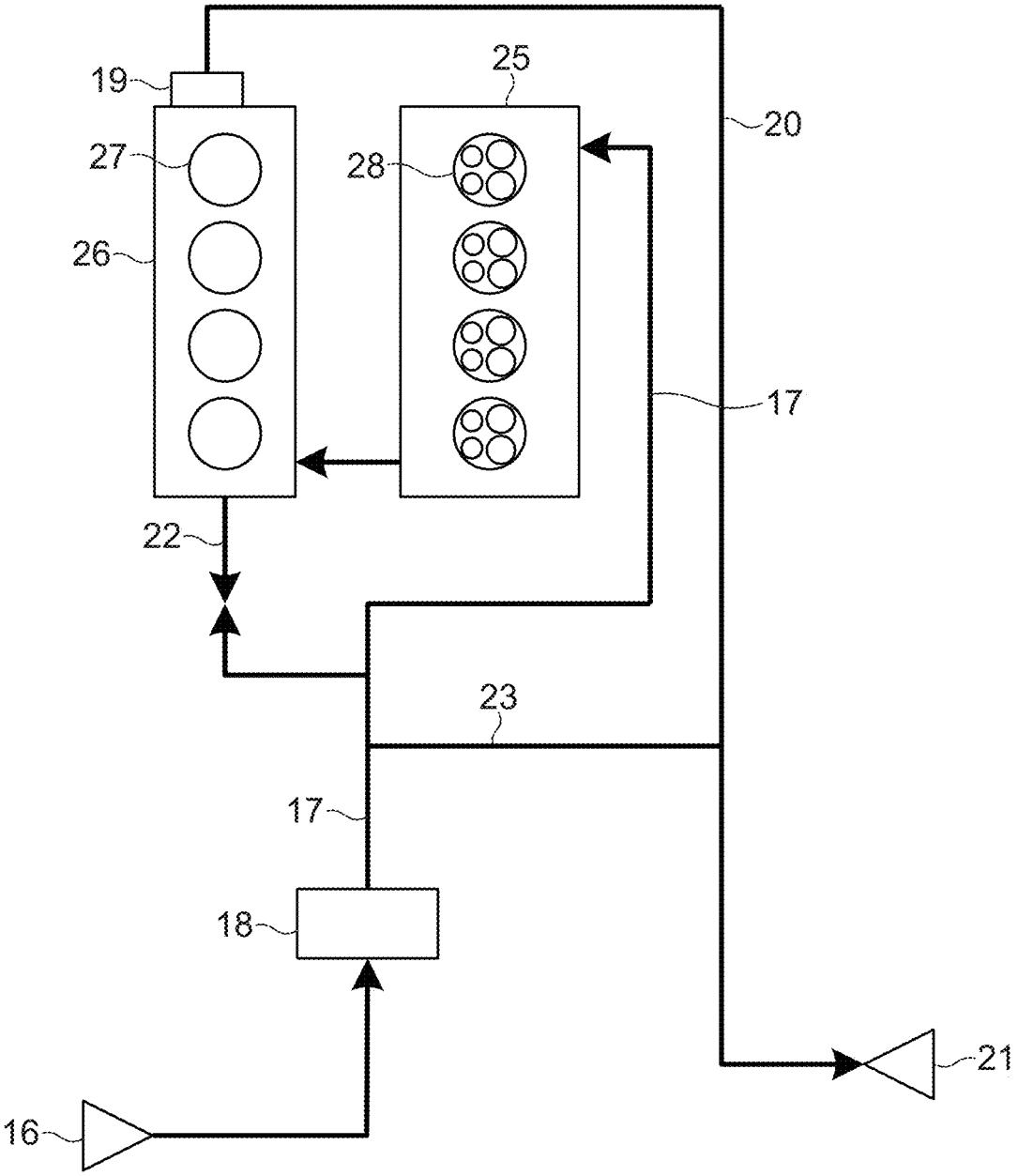
FIG. 2 Prior Art
FIG. 2 is a figure for explaining the flow of cooling water in the conventional marine cooling system.

FIG. 2 is a figure for explaining the flow of the cooling water in the conventional marine cooling system, and the arrows in FIG. 2 indicate a flow direction of the cooling water. Further, in FIG. 2, the engine 13 is shown separately as the cylinder head 25 and the cylinder body 26. A plurality of cylinders 27, in which a piston (not shown) moves up and down, are provided in the cylinder body 26, and a plurality of combustion chambers 28 corresponding to the plurality of cylinders 27 respectively are provided in the cylinder head 25.

In FIG. 2, first, the cooling water, which is taken in from the outside of the outboard motor 12 by the water suction port 16, reaches the water pump 18, and then is pressure-fed to the cylinder head 25 by the water pump 18. The cooling water, which is pressure-fed to the cylinder head 25, flows through a water jacket of the cylinder head 25 to cool the cylinder head 25. Then, the cooling water, which has flowed through the water jacket of the cylinder head 25, flows into the cylinder body 26.

The cooling water, which has flowed into the cylinder body 26, flows through a water jacket of the cylinder body 26 to cool the cylinder body 26. The cooling water, which has flowed through the water jacket of the cylinder body 26, flows into the drainage flow passage 20 via the thermostat 19, and then the drainage flow passage 20 discharges the cooling water, which has flowed into the drainage flow passage 20, from the drainage port 21 to the outside of the outboard motor 12. In the case that the water temperature of the cooling water is low, since a valve opening of the thermostat 19 is not performed, the cooling water stays in the water jacket of the cylinder body 26 and does not cool each cylinder 27 significantly such that the temperature of each cylinder 27 becomes a temperature suitable for combustion.

Figure 3:
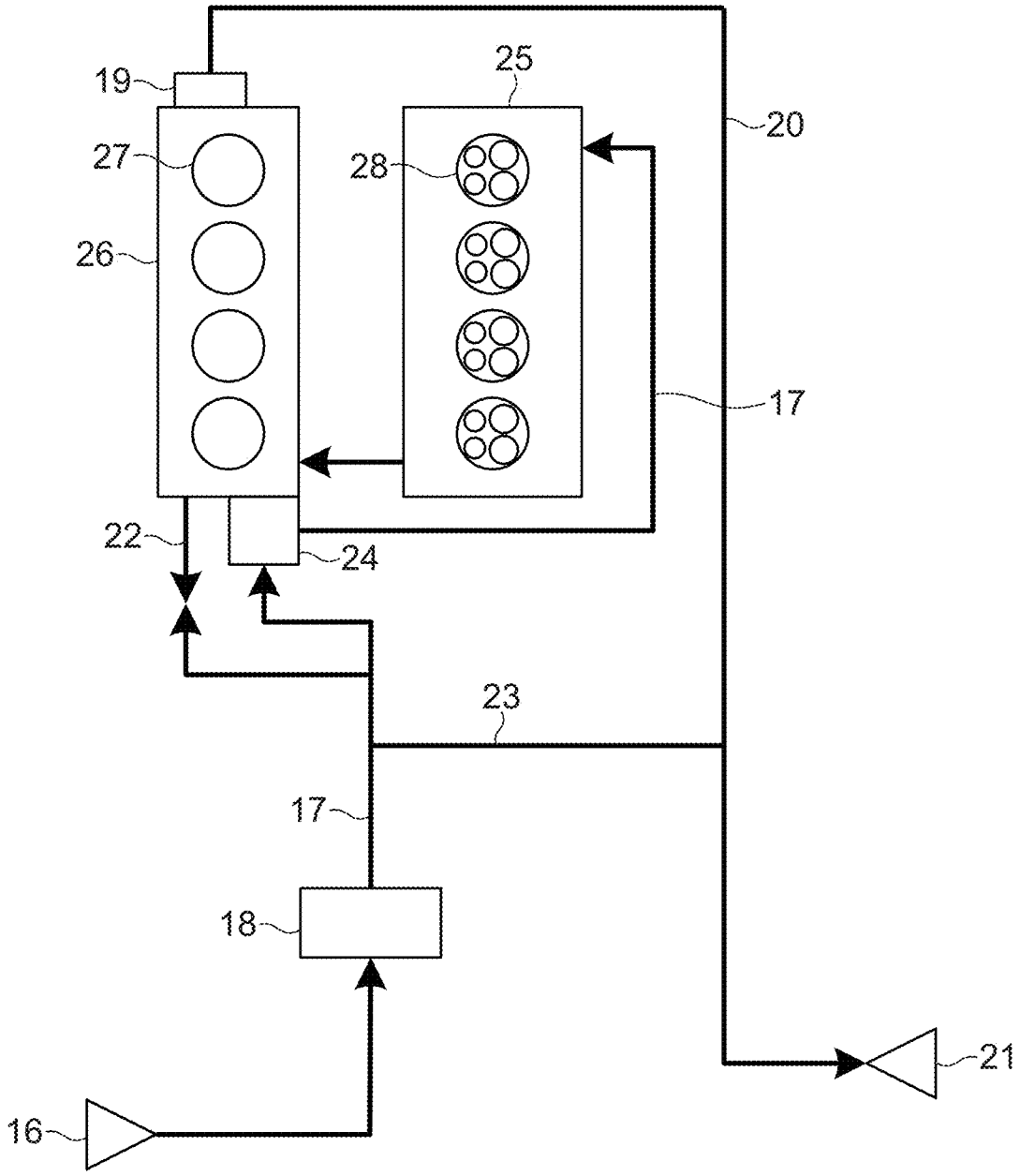
FIG. 3 Prior Art
FIG. 3 is a figure for explaining the flow of the cooling water in another conventional marine cooling system.

As shown in FIG. 3, the water supply flow passage 17 may be connected to the cylinder body 26 instead of the cylinder head 25. In this case, the cooling water is pressure-fed to the cylinder body 26 by the water pump 18. The cooling water, which is pressure-fed to the cylinder body 26, flows through a portion 24, which does not come into contact with the cylinders 27 of the cylinder body 26, and then flows toward the cylinder head 25. After that, the cooling water flows along the same route as the cooling water shown in FIG. 2.

In the case of storing the marine vessel, although it is necessary to remove the cooling water from the cylinder head 25 and the cylinder body 26, when the outboard motor 12 is tilted up for storage of the marine vessel, since the cylinder body 26 is located below the cylinder head 25, it becomes difficult for the cooling water to be removed from the cylinder body 26.

Therefore, the water drain flow passage 22 is connected to a location of the cylinder body 26 below the cylinder head 25 when the outboard motor 12 is tilted up, and the cooling water is removed from the water jacket of the cylinder body 26. Specifically, when the engine 13 is stopped and the water pump 18 is not operating, such as when the marine vessel is stored, the cooling water of the water jacket of the cylinder body 26 flows from the water drain flow passage 22 into the drainage flow passage 20 via the water supply flow passage 17 and the bypass flow passage 23, and then is discharged from the drainage port 21.

In the marine cooling systems shown in FIG. 2 and FIG. 3, since the water drain flow passage 22 is connected to the water supply flow passage 17, in the case that the engine 13 is in operation and the water pump 18 is operating, for example, in the case that the marine vessel 10 is sailing, the cooling water also flows from the water supply flow passage 17 into the water drain flow passage 22. In the water drain flow passage 22, the cooling water, which is discharged from the water jacket of the cylinder body 26, collides with the cooling water that has flowed into the water drain flow passage 22 as a result of being pumped by the water pump 18 so that a large amount of the cooling water is not discharged from the water jacket of the cylinder body 26.

On the other hand, in the case that the flow rate of the cooling water pressure-fed by the water pump 18 decreases, for example, in the case that the engine 13 is in a low load operation, the cooling water that flows into the water jacket of the cylinder body 26 via the cylinder head 25 also decreases. At this time, the flow rate of the cooling water that flows into the water drain flow passage 22 as a result of being pumped by the water pump 18 may exceed the flow rate of the cooling water discharged from the water jacket of the cylinder body 26. As a result, the cooling water that flows into the water drain flow passage 22 as a result of being pumped by the water pump 18 flows backward into the water drain flow passage 22, enters the water jacket of the cylinder body 26, and directly contacts the cylinder disposed near an opening of the water drain flow passage 22. Since the cooling water flowing into the water drain flow passage 22 as a result of being pumped by the water pump 18 does not pass through the cylinder head 25, the water temperature remains low, and the cylinder may be overcooled by the direct contact of the cooling water. If the cylinder is overcooled, there is a possibility that the temperature of an inner wall surface of the cylinder drops and fuel injected into the cylinder is liquefied on the inner wall surface and mixed with lubricating oil. Therefore, the conventional marine cooling system has room for improvement from the viewpoint of preventing dilution of the lubricating oil.

Figure 4:
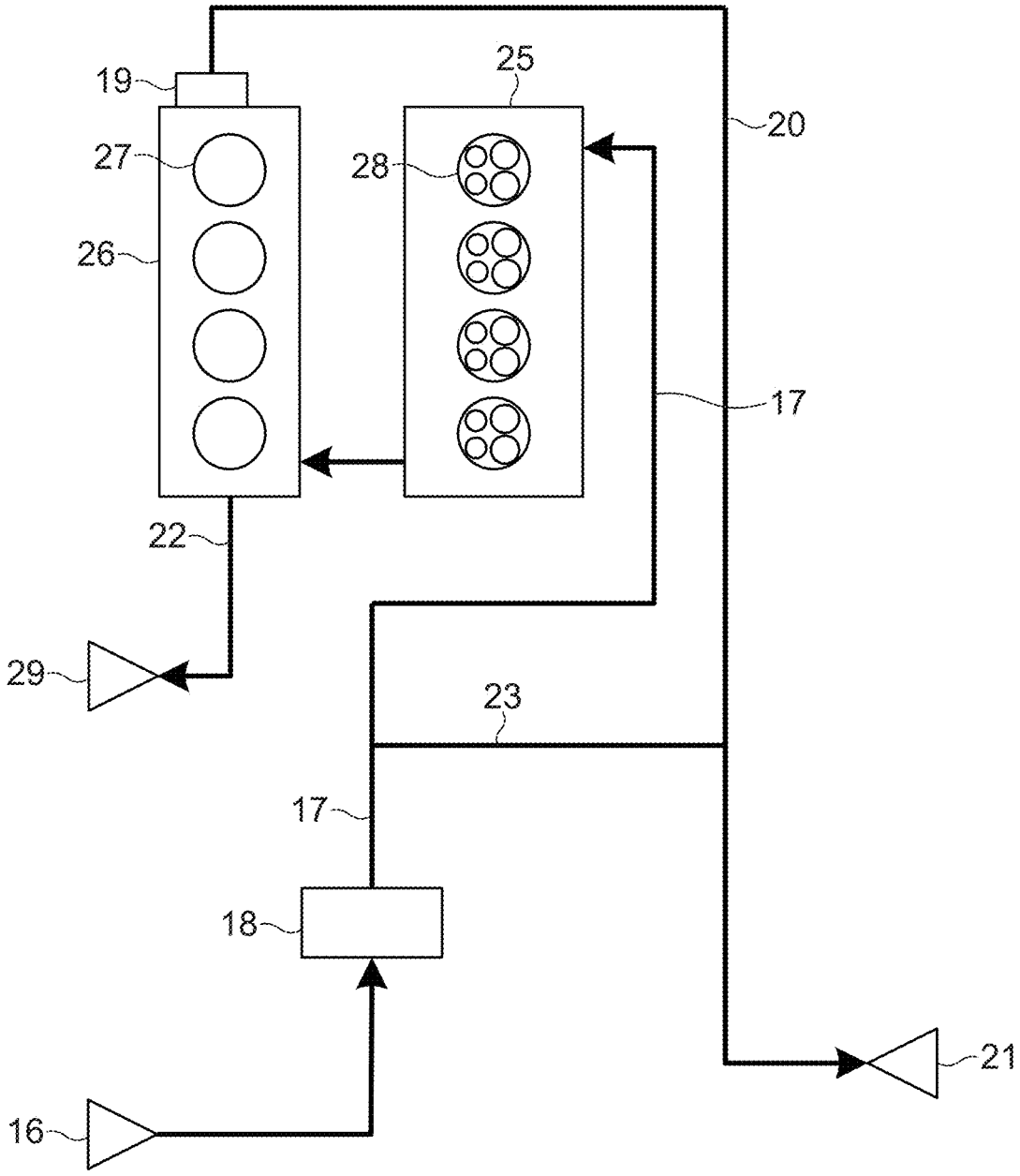
FIG. 4 Prior Art
FIG. 4 is a figure for explaining the flow of the cooling water in another conventional marine cooling system.

FIG. 4 is a figure for explaining the flow of the cooling water in another conventional marine cooling system, and the arrows in FIG. 4 indicate the flow direction of the cooling water. In the conventional marine cooling system shown in FIG. 4, the water drain flow passage 22 is not connected to the water supply flow passage 17 but is connected to another drainage port 29. Therefore, in the conventional marine cooling system shown in FIG. 4, unlike the conventional marine cooling system shown in FIG. 2, although the cooling water does not flow into the water drain flow passage 22 as a result of being pumped by the water pump 18, the cooling water of the water jacket of the cylinder body 26 is constantly discharged from the drainage port 29 via the water drain flow passage 22. As a result, in the case that the water temperature of the cooling water is low and the valve opening of the thermostat 19 is not performed, since the cooling water flows through the water jacket of the cylinder body 26 toward the water drain flow passage 22, the cylinder may still be overcooled.

In the conventional marine cooling system shown in FIG. 4, in order to maintain the flow rate of the cooling water flowing from the water supply flow passage 17 into the drainage flow passage 20 via the cylinder head 25 and the cylinder body 26, it is necessary to set the capacity of the water pump 18 in consideration of the flow rate of the cooling water constantly discharged from the water drain flow passage 22, and as a result, the size of the water pump 18 becomes large. Therefore, the conventional marine cooling system has room for improvement also from the viewpoint of reducing the size and weight of the outboard motor 12.

Accordingly, a first preferred embodiment of the present invention provides a marine cooling system that is able to significantly reduce or prevent overcooling of the cylinders of the cylinder body 26.

Figure 5:
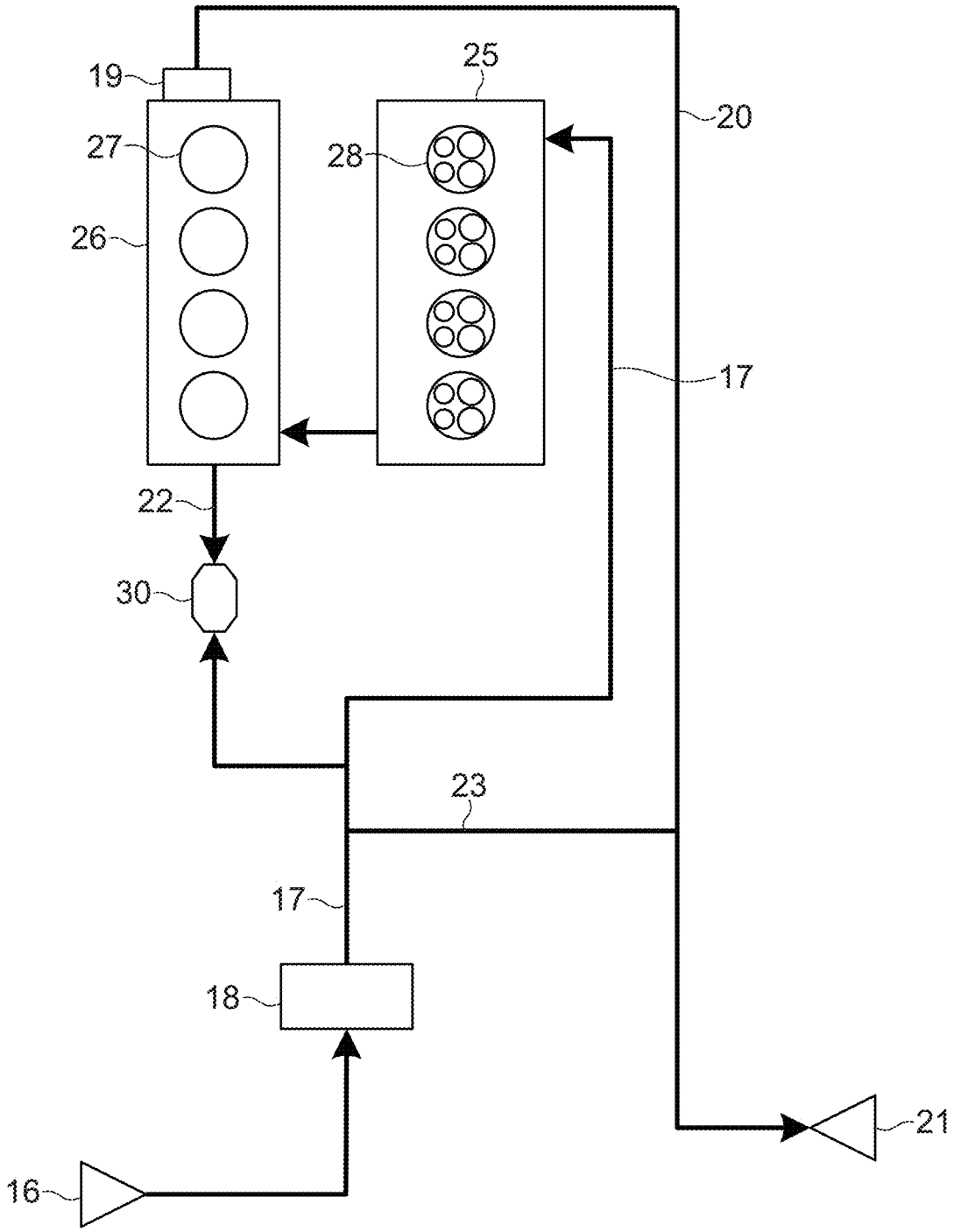
FIG. 5 is a figure for explaining the flow of the cooling water in a marine cooling system according to a first preferred embodiment of the present invention.

FIG. 5 is a figure for explaining the flow of the cooling water in a marine cooling system according to the first preferred embodiment of the present invention, and the arrows in FIG. 5 indicate the flow direction of the cooling water. The marine cooling system according to the present preferred embodiment of the present invention is premised on the conventional marine cooling system shown in FIG. 2, and is different from the conventional marine cooling system in that a check valve 30 described below is located in the water drain flow passage 22. In FIG. 5, the same components as those in FIG. 2 are designated by the same reference numerals, and the description thereof will be omitted.

Figure 6C:
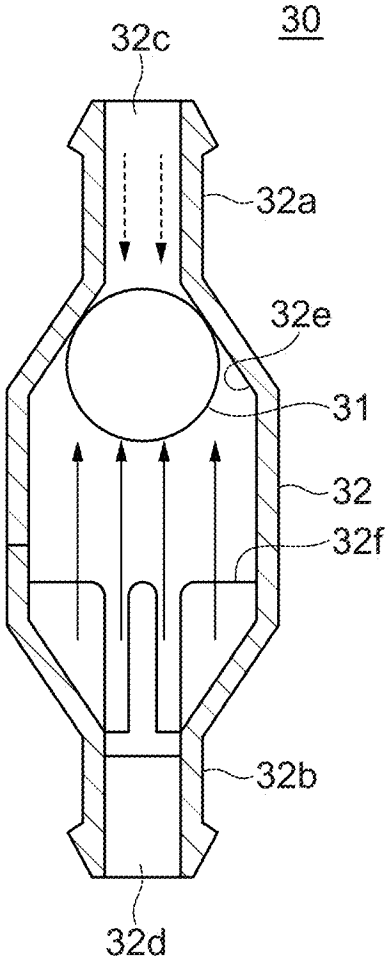
FIGS. 6A to 6C are sectional views that schematically show the structure of a check valve according to the first preferred embodiment of the present invention.

As shown in FIG. 5, in the marine cooling system according to the first preferred embodiment of the present invention, the check valve 30 (a flow passage controller) is located in the water drain flow passage 22. As shown in FIG. 6A, the check valve 30 includes a spherical check ball 31 (a valve body) and a substantially cylindrical check ball accommodation chamber 32 (a valve body accommodation chamber) to accommodate the check ball 31. The ends of the check ball accommodation chamber 32 include an upper reduced diameter portion 32*a* and a lower reduced diameter portion 32*b* that are reduced in diameter and able to be inserted into hoses (hereinafter referred to as "water drain hoses") of the water drain flow passage 22. The check ball 31 is made of a material having a density lower than that of the cooling water, for example, a resin.

The check valve 30 is located in the outboard motor 12 so that the lower reduced diameter portion 32*b* is lower than the upper reduced diameter portion 32*a* when the marine vessel 10 is sailing, or when the outboard motor 12 is tilted up. The upper reduced diameter portion 32*a* includes an upper opening 32*c* (a first opening) that opens at the end. When the water drain hose on the cylinder body 26 side is connected to the upper reduced diameter portion 32*a*, the inside of the check ball accommodation chamber 32 and the water jacket of the cylinder body 26 communicate with each other via the water drain hose on the cylinder body 26 side and the upper opening 32*c*. The lower reduced diameter portion 32*b* includes a lower opening 32*d* (a second opening) that opens at the end. When the water drain hose on the water supply flow passage 17 side is connected to the lower reduced diameter portion 32*b*, the inside of the check ball accommodation chamber 32 and the outside of the outboard motor 12 communicate with each other via the lower opening 32*d*, the water drain hose on the water supply flow passage 17 side, the water supply flow passage 17, the bypass flow passage 23, and the drainage flow passage 20.

On the upper opening 32*c* side of the check ball accommodation chamber 32, a tapered portion 32*e* has a gradually decreasing diameter toward the upper opening 32*c*. On the lower opening 32*d* side of the check ball accommodation chamber 32, a blocking portion 32*f* including a plurality of ribs located at positions spaced away from the lower opening 32*d* is provided.

In the check valve 30, since the inside of the check ball accommodation chamber 32 and the water jacket of the cylinder body 26 communicate with each other via the upper opening 32*c*, the cooling water flows into the check ball accommodation chamber 32 from the upper opening 32*c* regardless of whether the water pump 18 is operating or not. On the other hand, since the inside of the check ball accommodation chamber 32 and the water supply flow passage 17 communicate with each other via the lower opening 32*d*, when the engine 13 is in operation and the water pump 18 is operating, for example, when the marine vessel 10 is sailing, the cooling water flows from the lower opening 32*d* into the inside of the check ball accommodation chamber 32, but when the water pump 18 is not operating, the cooling water does not flow from the lower opening 32*d* into the inside of the check ball accommodation chamber 32.

Figure 6B:
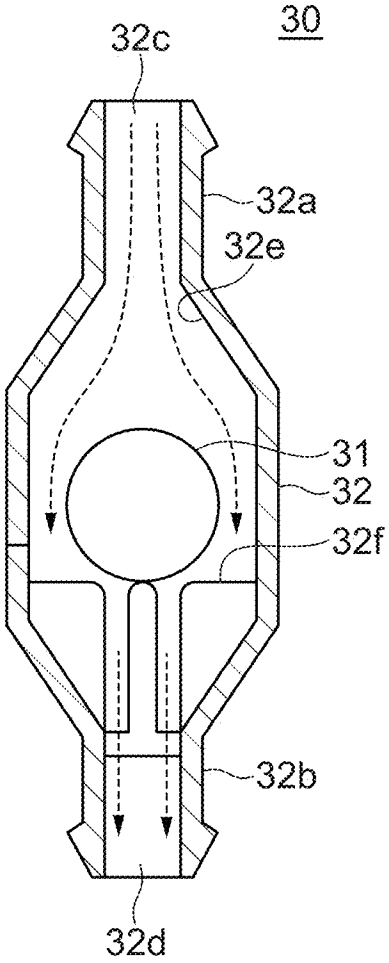
Figure 6A:
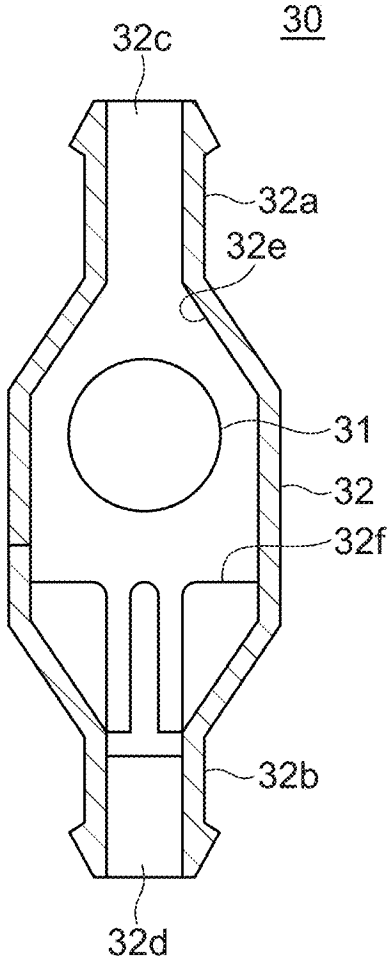

Since the check valve 30 is oriented so that the lower reduced diameter portion 32*b* is lower than the upper reduced diameter portion 32*a*, in the case that the water pump 18 is not operating and the cooling water does not flow from the lower opening 32*d* into the inside of the check ball accommodation chamber 32, as shown in FIG. 6B, the check ball 31 falls down toward the lower reduced diameter portion 32*b* side due to gravity and is received by the blocking portion 32*f*. Since the blocking portion 32*f* is located at a position spaced away from the lower opening 32*d*, the check ball 31 does not close the lower opening 32*d*. Therefore, the cooling water that has flowed into the inside of the check ball accommodation chamber 32 from the upper opening 32*c* is able to pass by the sides of the check ball 31 and flow toward the lower opening 32*d* (see broken line arrows in FIG. 6B). That is, when the engine 13 is not in operation and the water pump 18 is not operating, since the check ball 31 opens the water drain flow passage 22, it is possible to drain and reduce an amount of the cooling water in the water jacket of the cylinder body 26 through the check valve 30.

On the other hand, as shown in FIG. 6C, in the case that the water pump 18 is operating and the cooling water flows into the inside of the check ball accommodation chamber 32 from the lower opening 32*d*, the check ball 31 moves to the upper opening 32*c* side due to a buoyant force, and when the inside of the check ball accommodation chamber 32 is filled with the cooling water that has flowed in from the lower opening 32*d*, the check ball 31 abuts the tapered portion 32*e* of the check ball accommodation chamber 32 and closes the upper opening 32*c*. As a result, the cooling water (see solid line arrows in FIG. 6C) that has flowed into the inside of the check ball accommodation chamber 32 from the lower opening 32*d* cannot reach the upper opening 32*c*. That is, when the water pump 18 is operating, since the check ball 31 closes the water drain flow passage 22, the cooling water flowing into the water drain flow passage 22 as a result of being pumped by the water pump 18 does not flow backward in the water drain flow passage 22 and enter the water jacket of the body cylinder 26.

According to the marine cooling system of the first preferred embodiment, in the case that the water pump 18 is operating, since the water drain flow passage 22 is closed by the check ball 31 of the check valve 30, it is possible to prevent the cooling water that has flowed into the water drain flow passage 22 as a result of being pumped by the water pump 18 from flowing backward in the water drain flow passage 22 and into the water jacket of the cylinder body 26. As a result, it is possible to appropriately perform the temperature adjustment of the cylinders without overcooling the cylinders of the cylinder body 26.

Since the cylinders of the cylinder body 26 are not overcooled, it is possible to eliminate the necessity to set a valve opening temperature of the thermostat 19 high so as to significantly reduce or prevent overcooling of the cylinders and make it difficult for the cooling water to flow in the water jacket of the cylinder body 26. That is, since the valve opening temperature of the thermostat 19 is able to be set low, it is possible to improve the cooling capacity of the cylinder head 25. As a result, the ignition timing is able to be advanced while significantly reducing or preventing knocking, and it is possible to improve the output of the engine 13. Further, since it is possible to lower the overall temperature of the cooling water flowing through the marine cooling system by setting the valve opening temperature of the thermostat 19 low, in the case that the cooling water is seawater, it is possible to significantly reduce or prevent corrosion. As a result, it is possible to improve the durability of the marine cooling system, reduce sacrificial anticorrosion, and reduce the cost of the outboard motor 12.

In the marine cooling system according to the first preferred embodiment, in the case that the water pump 18 is operating, since the water drain flow passage 22 is closed by the check ball 31 of the check valve 30, it is possible to stop the cooling water from entering the water jacket of the cylinder body 26. This makes it possible to eliminate the necessity for the cooling water drained from the water jacket of the cylinder body 26 to collide with the cooling water that has flowed into the water drain flow passage 22 as a result of being pumped by the water pump 18, and thus, it is possible to eliminate the necessity to obtain a water pressure from the water pump 18 to cause the collision of the water. Further, the water drain flow passage 22 is not connected to another drainage port 29, and the cooling water is not constantly discharged from the water drain flow passage 22 to the outside of the outboard motor 12. Therefore, the capacity of the water pump 18 is able to be reduced, and the outboard motor 12 is further reduced in size and weight.

Next, a marine cooling system according to a second preferred embodiment of the present invention will be described. The components, operations, and effects of the second preferred embodiment are basically the same as those of the first preferred embodiment described above, and only the structure of a check valve of the second preferred embodiment is different from that of the first preferred embodiment. Therefore, the description of duplicated components, operations, and effects will be omitted, and different components, operations, and effects will be described below.

Figure 7A:
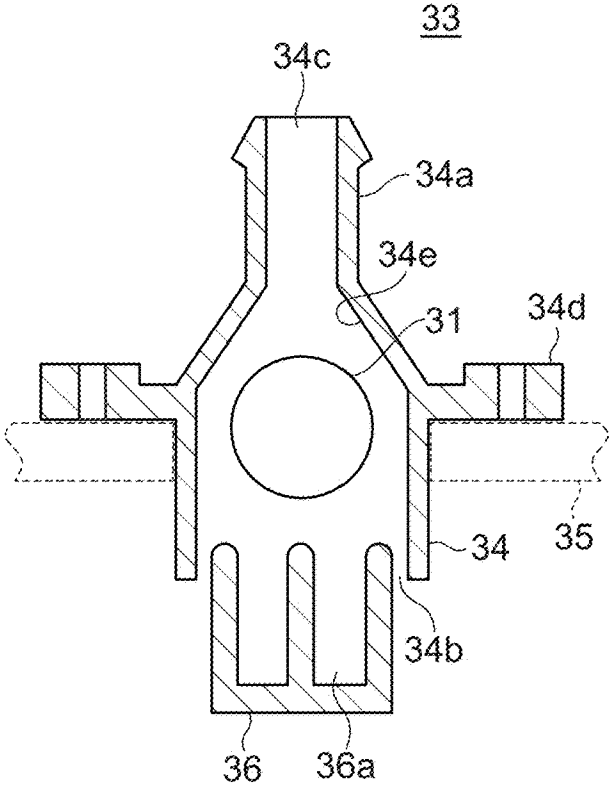
FIGS. 7A to 7C are sectional views that schematically show the structure of a check valve according to a second preferred embodiment of the present invention.
Figure 7B:
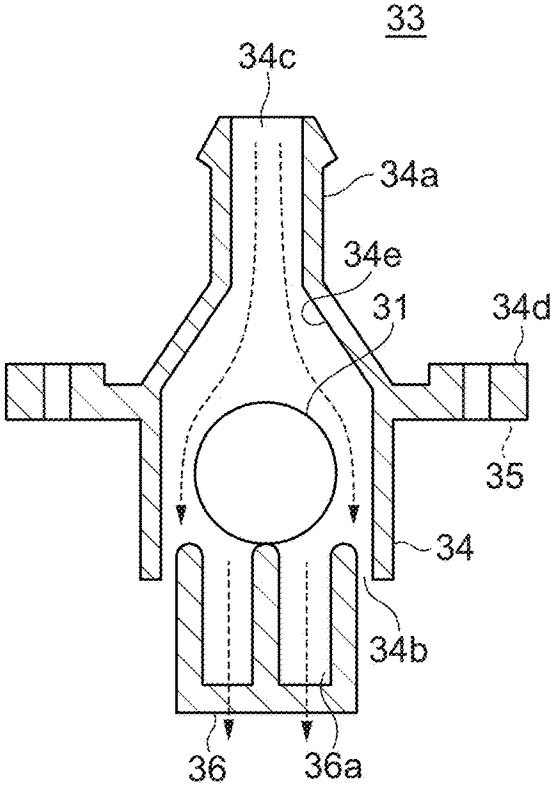
Figure 7C:
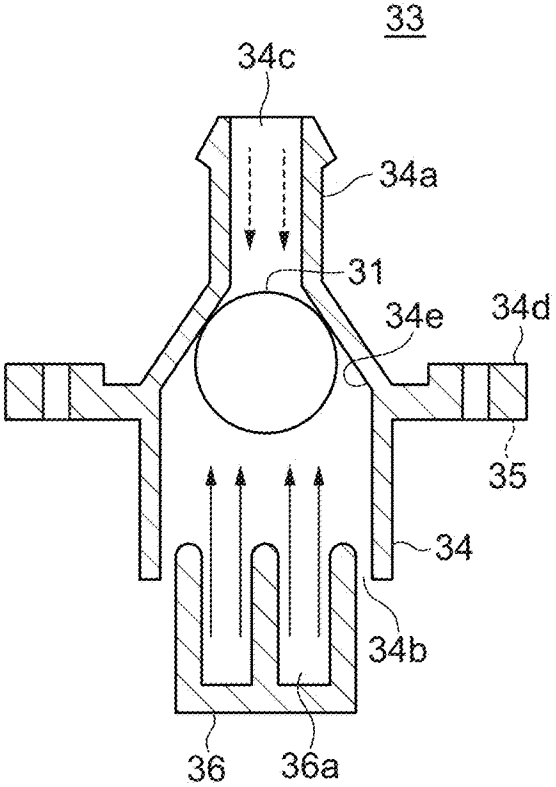

FIGS. 7A to 7C are section views that schematically show the structure of the check valve used in the marine cooling system according to the second preferred embodiment of the present invention.

As shown in FIG. 7A, a check valve 33 (the flow passage controller) in the second preferred embodiment of the present invention includes the check ball 31 (the valve body) and a substantially cylindrical check ball accommodation chamber (the valve body accommodation chamber) to accommodate the check ball 31. One end of the check ball accommodation chamber 34 includes an upper reduced diameter portion 34*a* that is reduced in diameter and is to be inserted into the water drain hose. Another end of the check ball accommodation chamber 34 is not reduced in diameter and is opened to define a lower opening 34*b* (the second opening). A flange 34*d* is provided on the outside of the check ball accommodation chamber 34, and the check ball accommodation chamber 34 is attached to a housing member 35 or the like defining a portion of the water drain flow passage 22 via the flange 34*d*.

The check valve 33 includes a basket-shaped blocking member 36. Although a portion of the blocking member 36 projects inside of the check ball accommodation chamber 34 from the lower opening 34*b*, a space in which the check ball 31 is able to move is provided in the inside of the check ball accommodation chamber 34. When the check ball accommodation chamber 34 is attached to the housing member 35, although most of the blocking member 36 is located in the inside of the housing member 35, the check ball 31 is prevented from falling down toward the inside of the housing member 35, and the inside of the check ball accommodation chamber 34 and the inside of the housing member 35 communicate with each other via clearance gaps 36*a* provided in the blocking member 36.

The check valve 33 is oriented in the outboard motor 12 so that the lower opening 34*b* is lower than the upper reduced diameter portion 34*a* when the marine vessel 10 is sailing, or when the outboard motor 12 is tilted up. The upper reduced diameter portion 34*a* includes an upper opening 34*c* (the first opening) that opens at the end. When the water drain hose on the cylinder body 26 side is connected to the upper reduced diameter portion 34*a*, the inside of the check ball accommodation chamber 34 and the water jacket of the cylinder body 26 communicate with each other via the water drain hose on the cylinder body 26 side and the upper opening 34*c*. When the check ball accommodation chamber 34 is attached to the housing member 35, the inside of the check ball accommodation chamber 34 and the outside of the outboard motor 12 communicate with each other via the lower opening 34*b*, the clearance gaps 36*a*, the water drain flow passage 22, the water supply flow passage 17, the bypass flow passage 23, and the drainage flow passage 20. Further, on the upper opening 34*c* side of the check ball accommodation chamber 34, a tapered portion 34*e* is provided that gradually reduces in diameter toward the upper opening 34*c*.

In the check valve 33, since the inside of the check ball accommodation chamber 34 and the water jacket of the cylinder body 26 communicate with each other via the upper opening 34*c*, the cooling water flows into the check ball accommodation chamber 34 from the upper opening 34*c* regardless of whether the water pump 18 is operating or not. On the other hand, since the inside of the check ball accommodation chamber 34 and the water supply flow passage 17 communicate with each other via the lower opening 34*b* and the clearance gaps 36*a*, when the engine 13 is in operation and the water pump 18 is operating, the cooling water flows from the lower opening 34*b* and the clearance gaps 36*a* into the inside of the check ball accommodation chamber 34. However, when the water pump 18 is not operating, the cooling water does not flow from the lower opening 34*b* and the clearance gaps 36*a* into the inside of the check ball accommodation chamber 34.

Since the check valve 33 is oriented so that the lower opening 34*b* is lower than the upper reduced diameter portion 34*a*, in the case that the water pump 18 is not operating and the cooling water does not flow from the lower opening 34*b* and the clearance gaps 36*a* into the inside of the check ball accommodation chamber 34, as shown in FIG. 7B, the check ball 31 falls down toward the lower opening 34*b* side due to gravity and is received by the blocking member 36. At this time, since a portion of the blocking member 36 enters the inside of the check ball accommodation chamber 34 from the lower opening 34*b*, the check ball 31 is kept at a location spaced away from the lower opening 34*b*, and the check ball 31 does not close the lower opening 34*b*. Therefore, the cooling water that has flowed into the inside of the check ball accommodation chamber 34 from the upper opening 34*c* is able to pass by the sides of the check ball 31 and flow toward the lower opening 34*b* and the clearance gaps 36*a* (see broken line arrows in FIG. 7B). That is, when the water pump 18 is not operating, since the check ball 31 opens the water drain flow passage 22, it is possible to drain and reduce an amount of the cooling water in the water jacket of the cylinder body 26 through the check valve 33.

On the other hand, as shown in FIG. 7C, when the water pump 18 is operating and the inside of the check ball accommodation chamber 34 is filled with the cooling water that has flowed in from the lower opening 34*b* and the clearance gaps 36*a*, the check ball 31 moves to the upper opening 32*c* side due to the buoyant force and then abuts the tapered portion 34*e* of the check ball accommodation chamber 34 so as to close the upper opening 34*c*. As a result, the cooling water (see solid line arrows in FIG. 7C) that has flowed into the inside of the check ball accommodation chamber 34 from the lower opening 34*b* and the clearance gaps 36*a* cannot reach the upper opening 34*c*. That is, when the water pump 18 is operating, since the check ball 31 closes the water drain flow passage 22, the cooling water flowing into the water drain flow passage 22 as a result of being pumped by the water pump 18 does not flow backward in the water drain flow passage 22 and enter the water jacket of the cylinder body 26.

As described above, the check valve 33 achieves the same effects as the check ball 31 in the first preferred embodiment.

Although preferred embodiments of the present invention have been described above, the present invention is not limited to the above-described preferred embodiments, and various modifications and changes can be made within the scope of the gist thereof.

For example, although there are no particular restrictions on the location of the check valve 30 (33) in the outboard motor 12, from the viewpoint of reliably removing the cooling water from the water jacket of the cylinder body 26, and since it is preferable to prevent the cooling water from flowing into the inside of the check ball accommodation chamber 32 (34), it is preferable to locate the check valve 30 (33) at a location not below the water surface in the outboard motor 12.

Figure 8:
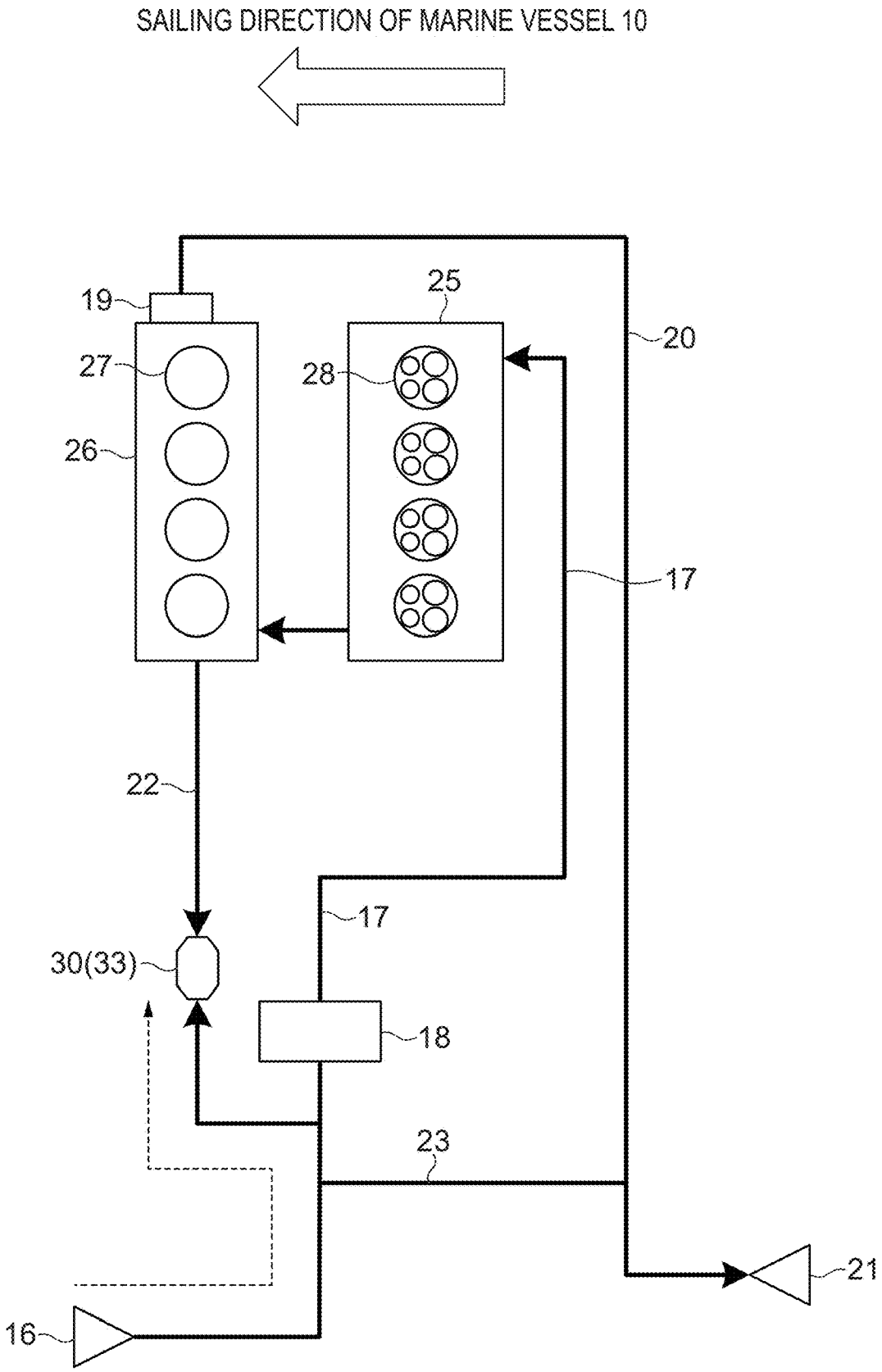
FIG. 8 is a figure for explaining the flow of the cooling water in a first variation of a preferred embodiment of a marine cooling system of the present invention.

Although the above-described marine cooling systems include the water pump 18, for example, as shown in FIG. 8, a configuration that the water suction port 16 faces a sailing direction of the marine vessel 10, a pressure due to the sailing of the marine vessel 10 is applied to the cooling water taken in from the water suction port 16, and the cooling water flows into the check valve 30 (33) from the opposite side of the cylinder body 26 (see broken line arrows in FIG. 8) may be used. In this case, since it is not necessary for the cooling water to flow into the check valve 30 (33) as a result of being pumped by the water pump 18, the capacity of the water pump 18 is further reduced, and the outboard motor 12 is able to be made smaller in size and lighter in weight.

Figure 9:
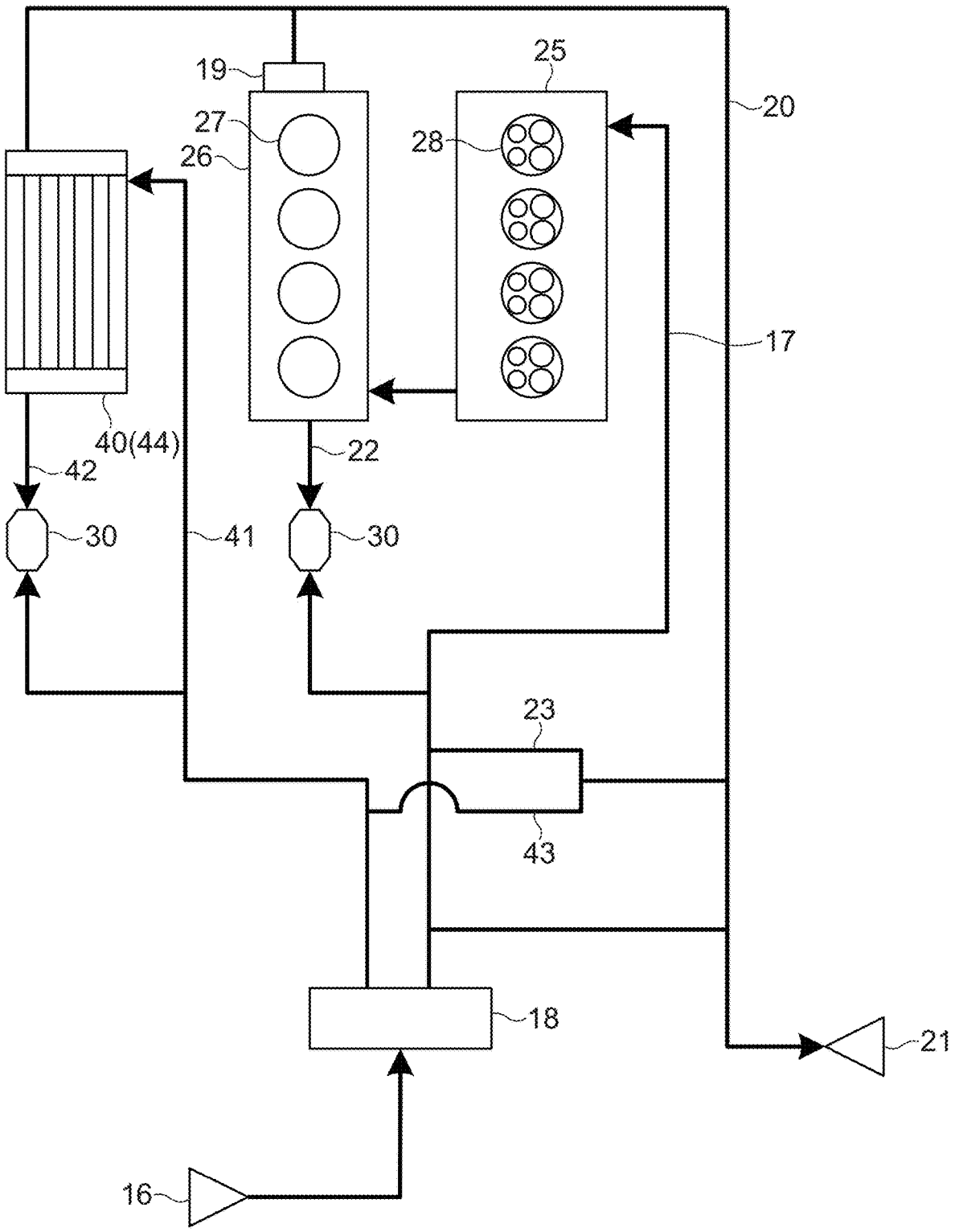
FIG. 9 is a figure for explaining the flow of the cooling water in a second variation of a preferred embodiment of a marine cooling system of the present invention.

Further, in the above-described first preferred embodiment and the above-described second preferred embodiment, although the check valve 30 (33) is used to prevent overcooling of the cylinders 27 of the cylinder body 26, in the outboard motor 12, the check valve 30 (33) may be used to prevent overcooling of other components that require water drainage when the marine vessel is stored. For example, as shown in FIG. 9, the check valve 30 (33) may be used to prevent overcooling of an oil cooler 40 of the outboard motor 12. In this marine cooling system, the cooling water is pressure-fed to the oil cooler 40 by the water pump 18 via a water supply flow passage 41, the cooling water pressure-fed to the oil cooler 40 flows through a core portion of the oil cooler 40 so as to cool the oil cooler 40, and the cooling water that has flowed through the core portion of the oil cooler 40 flows into the cylinder body 26.

In order to avoid damage due to corrosion due to the cooling water or freezing of the cooling water, the oil cooler 40 is also connected to a water drain flow passage 42 separately from the drainage flow passage 20, and the water drain flow passage 42 is connected to the water supply flow passage 41. Moreover, the water supply flow passage 41 is connected to the drainage flow passage 20 via a bypass flow passage 43. When the marine vessel 10 is stored, the cooling water in the core portion of the oil cooler 40 is discharged from the drainage port 21 via the water drain flow passage 42, the water supply flow passage 41, the bypass flow passage 43, and the drainage flow passage 20.

Further, as with the water drain flow passage 22, the check valve 30 is located in the water drain flow passage 42. As a result, even in the case that the water pump 18 is operating, since the check valve 30 prevents the cooling water flowing backward in the water drain flow passage 42 from the water pump 18 into the oil cooler 40, it is possible to prevent the oil cooler 40 from being cooled more than necessary. As a result, the viscosity of the oil used to lubricate the engine 13 is appropriately maintained, and the durability and fuel efficiency of the engine 13 is improved. Further, the marine cooling system of FIG. 9 may be used for cooling components other than the oil cooler 40, and for example, in order to cope with both preventing overcooling of a regulator/rectifier 44, which is an electrical component, and draining water of the regulator/rectifier 44, the marine cooling system of FIG. 9 may be used.

Further, in the case that the outboard motor 12 is equipped with not only the engine 13 but also an electric motor as a prime mover, the marine cooling system according to each of the above-described preferred embodiments may be used to cool the electric motor. Furthermore, in each of the above-described preferred embodiments, although the case that the marine cooling systems of preferred embodiments of the present invention are applied to the outboard motor 12 has been described, the marine cooling systems of preferred embodiments of the present invention may be used to cool an inboard/outboard motor or an inboard motor.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine cooling system to cool an object in a marine vessel, the marine cooling system comprising:

a water supply flow passage to supply cooling water to the object;

a water drain flow passage to drain the cooling water from the object; and a flow passage controller located within the water drain flow passage and configured to close the water drain flow passage; wherein when the marine vessel is sailing, the cooling water is supplied to the flow passage controller from a first side of the flow passage controller opposite to a second side of the flow passage controller, the second side of the flow passage controller being connected to a portion of the water drain flow passage that is connected to and drains the cooling water from the object.

2. The marine cooling system according to claim 1, further comprising:

a pump to supply the cooling water to the object and the flow passage controller; wherein the pump supplies the cooling water to the first side of the flow passage controller.

3. The marine cooling system according to claim 1, wherein, when the marine vessel is sailing, the cooling water is taken in from an outside of the marine vessel and supplied to the first side of the flow passage controller.

4. The marine cooling system according to claim 1, wherein the flow passage controller includes a valve body; and when the cooling water is supplied to the first side of the flow passage controller, the valve body closes the water drain flow passage; and when the cooling water is supplied to the second side of the flow passage controller, the valve body opens the water drain flow passage.

5. The marine cooling system according to claim 4, wherein the flow passage controller includes a valve body accommodation chamber that accommodates the valve body; and the valve body moves inside the valve body accommodation chamber depending on whether or not the cooling water is supplied to the first side of the flow passage controller or the cooling water is supplied to the second side of the flow passage controller.

6. The marine cooling system according to claim 5, wherein a density of a material of the valve body is smaller than a density of the cooling water.

7. The marine cooling system according to claim 5, wherein the valve body accommodation chamber includes a first opening that communicates with the object and a second opening that communicates with an outside of the marine vessel;

when the cooling water is supplied to the first side of the flow passage controller, the valve body closes the first opening; and the valve body accommodation chamber includes a blocking portion at a location spaced away from the second opening, and when the cooling water is supplied to the second side of the flow passage controller, the valve body abuts the blocking portion.

8. The marine cooling system according to claim 7, wherein the valve body is a sphere, and the first opening includes a tapered portion; and when the cooling water is supplied to the first side of the flow passage controller, the sphere abuts the tapered portion.

9. The marine cooling system according to claim 1, wherein the object is a cylinder body of an internal combustion engine.

10. The marine cooling system according to claim 1, wherein the object is an electrical component.

11. The marine cooling system according to claim 1, wherein the object is an oil cooler.

12. A marine vessel comprising:

a marine cooling system to cool an object, the marine cooling system including:

a water supply flow passage to supply cooling water to the object;

a water drain flow passage to drain the cooling water from the object; and a flow passage controller located within the water drain flow passage and configured to close the water drain flow passage; wherein when the marine vessel is sailing, the cooling water is supplied to the flow passage controller from a first side of the flow passage controller opposite to a second side of the flow passage controller, the second side of the flow passage controller being connected to a portion of the water drain flow passage that is connected to and drains the cooling water from the object.

13. A marine propulsion device comprising:

a marine cooling system to cool an object, the marine cooling system including:

a water supply flow passage to supply cooling water to the object;

a water drain flow passage to drain the cooling water from the object; and a flow passage controller located within the water drain flow passage and configured to close the water drain flow passage; wherein when the marine vessel is sailing, the cooling water is supplied to the flow passage controller from a first side of the flow passage controller opposite to a second side of the flow passage controller, the second side of the flow passage controller being connected to a portion of the water drain flow passage that is connected to and drains the cooling water from the object.

14. A marine cooling system to cool an object in a marine vessel, the marine cooling system comprising:

a water drain flow passage to drain cooling water from the object; and a flow passage controller located within the water drain flow passage and configured to close the water drain flow passage; wherein when the marine vessel is sailing, the cooling water is supplied to the flow passage controller from a first side of the flow passage controller opposite to a second side of the flow passage controller, the second side of the flow passage controller being connected to a portion of the water drain flow passage that is connected to and drains the cooling water from the object.

* * * * *